United States Patent [19]

Klaric

[11] 4,335,861

[45] Jun. 22, 1982

[54] SHELVING SYSTEM

[76] Inventor: Dinko Klaric, 165 City Rd., South Melbourne, Victoria, 3205, Australia

[21] Appl. No.: 145,497

[22] Filed: Apr. 29, 1980

[30] Foreign Application Priority Data

May 2, 1979 [AU] Australia ..... PD8622
May 22, 1979 [AU] Australia ..... PD8914

[51] Int. Cl.[3] ..... A47G 29/02; E04G 3/08; E06G 7/28

[52] U.S. Cl. ..... 248/246; 29/432; 403/284; 248/222.1

[58] Field of Search ..... 248/246, 222.3, 222.1, 248/223.3, 73, 243; 29/432; 403/284

[56] References Cited

U.S. PATENT DOCUMENTS 3,429,540 2/1969 Worrallo ..... 248/246
3,865,337 2/1975 Towfigh et al. ..... 248/246
4,174,486 11/1979 Winkler ..... 248/246
4,240,764 12/1980 Wegner ..... 248/243 X

FOREIGN PATENT DOCUMENTS 2737973 3/1978 Fed. Rep. of Germany ..... 248/246
751485 6/1956 United Kingdom ..... 248/222.1

*Primary Examiner*—Wayne L. Shedd
*Attorney, Agent, or Firm*—Nathaniel A. Humphries

[57] ABSTRACT

A shelving system comprising a shelf bracket of light weight material adapted to be fixed to an elongated substantially vertical slotted member. The bracket includes an insert of high tensile strength a portion of which is firmly embedded in the bracket at or near the top load carrying edge thereof. The insert has a free end extending from the bracket. Abutment means are provided adjacent the bottom edge of the bracket. The free end of the insert is shaped to engage the slot in the slotted member, while the abutment means abuts against the slotted member. A load placed on the bracket causes it to be firmly fixed in position relative to the slotted member through cantilever action.

10 Claims, 4 Drawing Figures

SHELVING SYSTEM

FIELD OF THE INVENTION

This invention relates to a shelving system of the type in which the shelves are supported on brackets located in position on elongated upright members. In particular, this invention relates to an improved shelving bracket for such a shelving system.

DESCRIPTION OF THE PRIOR ART

One prior art system uses upright members having hollow, square cross-section. One face of the upright is provided with a series of regularly spaced slots extending along the length of the upright. The shelf brackets are provided with lugs that are inserted into the slots to firmly locate the shelf.

Another prior art system uses elongated upright members of generally square U-section. The shelf brackets are also provided with lugs that mate with the groove formed by the legs of the U-section. The brackets are also provided with horizontally extending lugs that mate with correspondingly shaped horizontal recesses provided in the legs of the U-section.

One distinct disadvantage of these prior systems is that they do not allow infinite adjustment of the position of the shelves in relation to the supports.

It is desirable to manufacture the brackets and supports from a material that is light in weight, and is relatively easy to form, such as by extrusion. However, it has been found that aluminium brackets and uprights do not have sufficient strength to support heavy objects. One way of overcoming this disadvantage, is to increase the sectional size of the brackets and uprights, which results in a large and cumbersome system. Another solution is to use mild steel components, but this increases the cost and difficulty of manufacture, and removes the light weight advantage of aluminium.

The object of this invention is to overcome the disadvantage inherent in the prior art shelving systems mentioned above by combining the strength of a material such as steel with the lightness of a material such as aluminium. The invention also provides a shelving system in which the position of the shelf brackets, in relation to the upright members, in infinitely adjustable.

BRIEF SUMMARY OF THE INVENTION

In accordance with the invention, there is provided a shelving system comprising a shelf bracket, fixing means on said bracket adapted to fix said bracket to a longitudinally extending substantially vertical slotted member, said fixing means comprising an insert of high tensile strength firmly embedded in the bracket at or near the top load carrying edge thereof, and abutment means adjacent the bottom edge of the bracket, said insert being shaped to engage the slotted member whilst said abutment means abuts against the slotted member, whereby the bracket is firmly held in position on said slotted member by cantilever action between the bracket and the slotted member when a load is placed on the bracket.

Since the cantilever action locks the shelf in position, it can be locked in any position along the length of the slot.

Conveniently, the slot is provided in an aluminium extrusion of generally square, C-shaped cross-section, which can be affixed to a wall or other structure.

Preferably the embedded portion of the insert includes a limb disposed perpendicularly to the force exerted on said insert by a load placed on said bracket. Additionally or alternatively, the embedded portion may include a serrated limb with the serrations extending perpendicularly to said force.

The bottom edge of the bracket may also include a wedge-shaped portion which is adapted to wedge itself into the slot when a load is placed on the bracket. Additionally or alternatively, a serrated insert is provided near the bottom edge, whereby the serrations can be force-fitted into the slot. These modifications enhance the stability of the shelving system.

The shelf bracket is preferably fabricated from aluminium, and the insert may be of mild steel, preferably hardened, or other high tensile strength metallic or plastics material.

Conveniently, a pair of brackets can be punched from a single extrusion, thus saving on manufacturing costs.

BRIEF DESCRIPTION OF THE DRAWINGS

The invention will now be described in more detail with reference to the accompanying drawings, in which.

DETAILED DESCRIPTION OF THE INVENTION

Figures 1, 2, 3, 4:
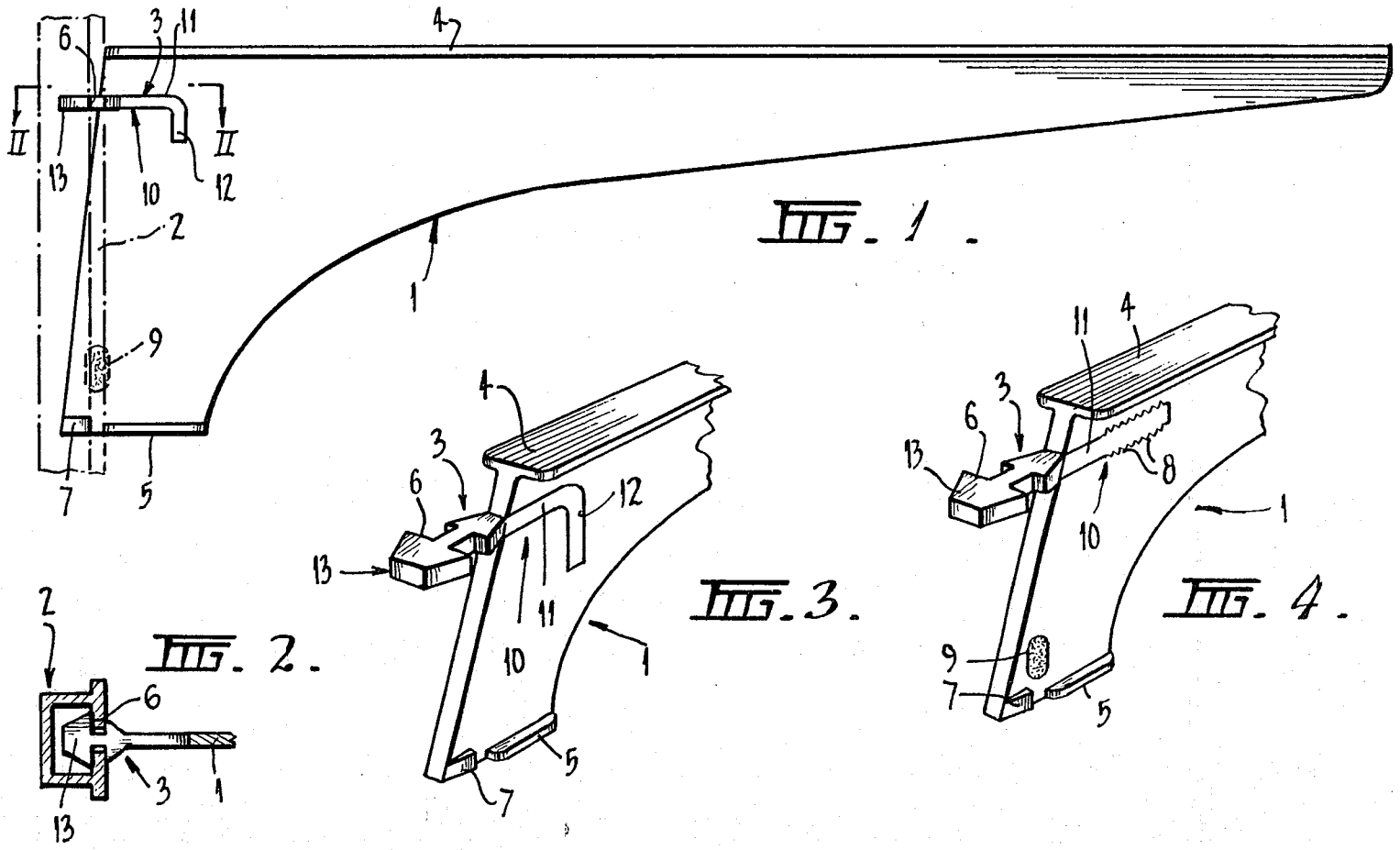
FIG. 1 is a side elevational view of a preferred embodiment of the invention.
FIG. 2 is a sectional plan view taken from the direction of arrows II—II in FIG. 1.
FIG. 3 is a perspective view of the shelf fixing means.
FIG. 4 is a view similar to FIG. 3 but showing a modified form of fixing means.

The shelf bracket is fixed to the vertical member 2 by fixing means comprising an insert 3. The bracket 1 is punched from an 1-cross-section aluminium extrusion the top bar of the 1 forming the load carrying surface 4, and the bottom bar of the 1 forming abutment means 5.

As can be seen clearly in FIG. 3, insert 3, which is fabricated from a high tensile strength material such as mild steel, preferably hardened, or from a high tensile strength plastics material, includes as embedded portion 10 having horizontal limb II and a vertical limb 12 substantially perpendicular to horizontal limb II. The modified insert in FIG. 4 incorporates serrated faces 8 extending perpendicularly to limb II.

In use the bracket is inserted with the T-shaped free end 13 into the slot by first turning it through 90 degrees. It is then rotated to its normal position and moved along the slot to the desired position. A load, for example a wooden or glass shelf, is placed on the top surface 4 of the bracket. The resultant cantilever action around fulcrum 6 formed by the T-shaped free end 13 forces abutment means 5 against the outer surface of the slot and locks the shelf in position without the need for separate locating means.

The vertical limb 12 of the FIG. 3 embodiment, and the serrations 8 of the FIG. 4 embodiment effectively carry the force transmitted by cantilever action by the load on the bracket.

To facilitate positioning of the shelf bracket, the bottom edge adjacent the abutment is provided with a tapered portion 7 adapted to wedge the bottom edge of the shelf bracket in the slot.

FIG. 4 shows a modified fixing means, wherein the insert 3 is provided with serrated faces 8 before it is embedded in a slot in the bracket 1.

Additionally, positioning of the shelf can be further facilitated by including a further serrated insert 9 also embedded in the bracket. The teeth of this insert can be force-fitted into the slot in the vertical member 2.

I claim:

1. A shelving system comprising a shelf bracket formed of a first material and having a top load carrying edge, fixing means on said bracket adapted to fix said bracket to a longitudinally extending substantially vertical slotted member having an elongated vertical slot, characterized in that said fixing means comprises an insert formed of a second material of higher tensile strength than said first material, said fixing means having a portion firmly embedded in the bracket at or near the top load carrying edge thereof and a free end extending from said bracket, and abutment means adjacent the bottom edge of the bracket, the free end of said insert being shaped to engage the slotted member whilst said abutment means abuts against the slotted member, whereby the bracket is firmly held in position on said slotted member by cantilever action between the bracket and the slotted member when a load is placed on the bracket.

2. The shelving system of claim 1, wherein said embedded portion of said insert includes a limb disposed perpendicularly to the force exerted on said insert by a load placed on said bracket.

3. The shelving system of claim 1, wherein said embedded portion of said insert includes a serrated limb having serrations extending perpendicularly to the force exerted on said insert by a load placed on said bracket.

4. The shelving system of claim 1, wherein said free end is of a T-shape adapted to engage the rear faces of the slot in said slotted member.

5. The shelving system of claim 1, wherein the bottom edge of said bracket includes a wedge-shaped portion shaped and dimensioned to wedge itself into the slot when a load is placed on the shelf bracket.

6. The shelving system of claim 1, wherein the bottom edge of said bracket includes a serrated insert shaped and dimensioned to be force-fitted into the slot when a load is placed on the shelf bracket.

7. The shelving system of claim 1, wherein said shelf bracket is formed from an extrusion of I-cross section.

8. A shelving system as recited in claim 1, wherein said bracket is formed of aluminum and said insert is formed of steel.

9. The shelving system of claim 8, wherein said embedded portion of said insert includes a limb disposed perpendicularly to the force exerted on said insert by a load placed on said bracket.

10. A shelf bracket adapted to be fixed to a longitudinally extending, substantially vertical slot, characterized in that said bracket is formed of aluminum and includes an insert of high tensile strength formed of steel and having a portion firmly embedded in the bracket at or near a top load carrying edge of the bracket and a free end extending from said bracket, and abutment means adjacent the bottom edge of the bracket, the free end of said insert being shaped to engage the slot whilst said abutment means abuts against the slot, whereby the bracket is firmly held in position with respect to said slot by cantilever action between the bracket and the slot when a load is placed on the bracket.

* * * * *